US010315840B2

(12) United States Patent
Georgas et al.

(10) Patent No.: US 10,315,840 B2
(45) Date of Patent: Jun. 11, 2019

(54) POWERED LIFTING DEVICE FOR PORTABLE CONTAINER

(71) Applicant: I CUBED, LLC, Decherd, TN (US)

(72) Inventors: Taso Georgas, Decherd, TN (US); George Michalopoulos, Decherd, TN (US); Terry Beckham, II, Decherd, TN (US)

( * ) Notice: Subject to any disclaimer, the term of this patent is extended or adjusted under 35 U.S.C. 154(b) by 0 days.

(21) Appl. No.: 15/506,584

(22) PCT Filed: Sep. 2, 2015

(86) PCT No.: PCT/US2015/048108
§ 371 (c)(1),
(2) Date: Feb. 24, 2017

(87) PCT Pub. No.: WO2016/036835
PCT Pub. Date: Mar. 10, 2016

(65) Prior Publication Data

US 2017/0275096 A1 Sep. 28, 2017

Related U.S. Application Data

(60) Provisional application No. 62/046,127, filed on Sep. 4, 2014.

(51) Int. Cl.
*B65F 1/14* (2006.01)
*B65F 1/12* (2006.01)

(52) U.S. Cl.
CPC ..... *B65F 1/1452* (2013.01); *B65F 1/12* (2013.01)

(58) Field of Classification Search
CPC ..... B65F 1/12; B65F 1/1452
See application file for complete search history.

(56) References Cited

U.S. PATENT DOCUMENTS

| | | | | |
|---|---|---|---|---|
| 2,592,324 A * | 4/1952 | Oliver | B65F 3/08 | 414/409 |
| 2,647,651 A * | 8/1953 | Vincent | B60P 1/54 | 414/648 |
| 4,348,147 A * | 9/1982 | Helm | B65G 65/00 | 414/420 |
| RE34,292 E * | 6/1993 | Bingman | B65F 3/08 | 294/86.4 |
| 5,230,393 A * | 7/1993 | Mezey | B65F 3/08 | 177/139 |
| 5,582,500 A * | 12/1996 | Morris | B65F 1/1452 | 414/422 |
| 6,059,511 A | 5/2000 | Anderson et al. | | |
| 6,071,058 A | 6/2000 | Tetz et al. | | |
| 6,238,165 B1 * | 5/2001 | Fletcher | B65G 65/23 | 254/3 R |

(Continued)

FOREIGN PATENT DOCUMENTS

| | | |
|---|---|---|
| AU | 422015 | 10/1968 |
| WO | 2016036836 A1 | 3/2016 |

*Primary Examiner* — Kaitlin S Joerger
(74) *Attorney, Agent, or Firm* — Jefferson IP Law, LLP

(57) ABSTRACT

A powered, waste container lifting and tilting device is provided with a plurality of braces that can be universally attached to any receiving container, a retractable loading spike and strap that can be universally attached to any trash can, and a drive mechanism that can lift and tilt a trash can to easily transfer contents from the lifted trash can to the receiving container.

18 Claims, 15 Drawing Sheets

(56) References Cited

U.S. PATENT DOCUMENTS

| | | | | |
|---|---|---|---|---|
| 6,379,099 | B1 | 4/2002 | Novak | |
| 6,435,803 | B1 | 8/2002 | Robinson | |
| 6,494,665 | B1 * | 12/2002 | Bingman | B65F 3/08 414/409 |
| 6,644,907 | B1 * | 11/2003 | Pinder | B65G 65/23 414/424 |
| 7,018,155 | B1 * | 3/2006 | Heberling | B62B 3/0606 414/408 |
| 9,028,192 | B2 * | 5/2015 | Wahls | B65F 1/1452 414/408 |
| 9,126,755 | B2 * | 9/2015 | Walter | B65F 1/1452 |
| 2004/0208736 | A1 | 10/2004 | Mensch | |
| 2007/0131636 | A1 | 6/2007 | Spitsbergen | |
| 2008/0217277 | A1 | 9/2008 | Spitsbergen | |
| 2012/0048823 | A1 | 3/2012 | Kriner | |
| 2012/0199590 | A1 | 8/2012 | Therrien | |
| 2012/0261372 | A1 | 10/2012 | Peterson | |
| 2013/0093201 | A1 | 4/2013 | Li et al. | |
| 2013/0115041 | A1 | 5/2013 | Taylor et al. | |
| 2013/0216345 | A1 | 8/2013 | Townsend | |
| 2016/0144586 | A1 * | 5/2016 | Schwelling | B65G 65/23 100/215 |

* cited by examiner

POWERED LIFTING DEVICE FOR PORTABLE CONTAINER

CROSS-REFERENCE TO RELATED APPLICATIONS

This application is a National Phase Entry of PCT International Application No. PCT/US2015/048108, which was filed on Sep. 2, 2015, and claims the benefit under 35 U.S.C. 119(e) of a U.S. provisional patent application of Taso Georgas et al., entitled "Powered Lifting Device", Ser. No. 62/046,127, filed Sep. 4, 2014, the entire contents of which are incorporated herein by reference.

BACKGROUND OF THE INVENTION

Field of the Invention

The present invention relates to a powered, waste container lifting and tilting device that can be universally attached to any conventional outdoor waste receiving container, and then receive, lift and rotate conventional indoor waste collection containers such as trash cans to facilitate automatic transfer of contents from the trash cans to the receiving container.

Description of the Related Art

Large, conventional outdoor waste receiving containers, hereinafter referred to as simply "receiving containers", are often provided to collect trash from commercial, industrial and residential users before the trash is loaded into a truck. These receiving containers generally consist of large rectangular steel boxes located outside buildings, often in areas such as the back of the buildings alleys and parking lots. Each has one or more top access doors for depositing the trash therein and also for permitting the trash therein to be emptied, such as into a truck using actuated forklift arms. The forklift arms lift and tip the entire receiving container until its contents fall by gravity into the truck. In yet other applications, the entire receiving container can simply be pulled onto a tilted bed of the truck and removed entirely for content disposal.

Such receiving containers typically receive content from many conventional indoor waste collection containers, portable waste containers, trash cans and the like, hereinafter referred to as simply "trash cans". These trash cans generally consist of small to medium sized, circular steel or plastic containers located inside buildings. Since these trash cans store a smaller amount of waste, and are not designed to be emptied directly into trucks or to be loaded onto trucks for removal, the content of such trash cans are typically transferred to receiving containers. For example, trash cans are often shaped to facilitate use by individuals in indoor locations, and are often configured to provide ready disposal of small amounts of waste. In contrast, receiving containers are often shaped to collect larger amounts of waste for temporary storage, and for collection by heavy equipment in a quick and efficient manner. Accordingly, the content of such trash cans must be periodically transferred to receiving containers. To do so, handles are provided on sides of the trash cans and/or wheels are provided on a bottom surface of the trash cans to facilitate the movement of the trash can to the receiving containers.

Unfortunately, a user is then required to physically transfer the content from such trash cans to the receiving containers, wherein the receiving containers are not often compatible or designed to facilitate such transfers in an easy or safe manner. For example, a user is typically required to place the trash can adjacent to the receiving container and manually lift the trash can to a height dependent upon receiving container size, and manually tilt the trash can to an angle to transfer the contents from the trash can to the receiving container. In doing so, users are required to exert themselves when transferring contents between trash cans and receiving containers, and injuries and/or accidents can be expected, resulting in higher costs and greater insurance claims.

Accordingly, a need exists for an improved system and method to transfer contents from such trash cans to such receiving containers, even in the case where one or more of the trash can and receiving container are not compatible or designed to facilitate such transfers.

SUMMARY OF THE INVENTION

Accordingly, exemplary embodiments of the present invention address the above and other issues, and provide an improved system and method to transfer contents from such trash cans to such receiving containers, even in the case where one or more of the trash can and receiving container are not compatible or designed to facilitate such transfers.

An aspect of exemplary embodiments of the present invention is to provide an improved system and method that is compatible and designed to facilitate transfers between any configuration of trash can and any configuration of receiving container.

Another aspect of exemplary embodiments of the present invention is to provide a plurality of braces or other members that can be configured to attach a body of the exemplary embodiments of the present invention with any receiving container.

Another aspect of exemplary embodiments of the present invention is to provide a loading spike and/or strap or other members of the exemplary embodiments of the present invention that can be configured to secure any trash can for lifting and tilting.

Another aspect of exemplary embodiments of the present invention is to provide a drive mechanism or other mechanism of the exemplary embodiments of the present invention that can be configured to manually or automatically lift any trash can in a vertical manner along a side of any receiving container to a height that permits transfer of content from the trash can to the receiving container.

Another aspect of exemplary embodiments of the present invention is to provide a drive mechanism or other mechanism of the exemplary embodiments of the present invention that can be configured to automatically tilt or rotate any trash can when reaching a height along a side of any receiving container that permits transfer of content from the trash can to the receiving container.

To substantially achieve these and other aspects of the present invention, a powered, waste container lifting and tilting device is provided with a plurality of braces that can be universally attached to any receiving container, a retractable loading spike and strap that can be universally attached to any trash can, and a drive mechanism that can lift and tilt a trash can to easily transfer contents from the lifted trash can to the receiving container.

BRIEF DESCRIPTION OF THE DRAWINGS

These and other objects, advantages and novel features of the invention will become more readily appreciated from the following detailed description when read in conjunction with the accompanying drawings, in which.

Throughout the drawings, like reference numerals will be understood to refer to like parts, components and structures.

DETAILED DESCRIPTION OF EXEMPLARY EMBODIMENTS

As shown in the attached figures, a powered, waste container lifting and tilting device is provided with a plurality of braces that can be universally attached to any receiving container, a retractable loading spike and strap that can be universally attached to any trash can, and a drive mechanism that can lift and tilt a trash can to easily transfer contents from the lifted trash can to the receiving container.

Figure 1:
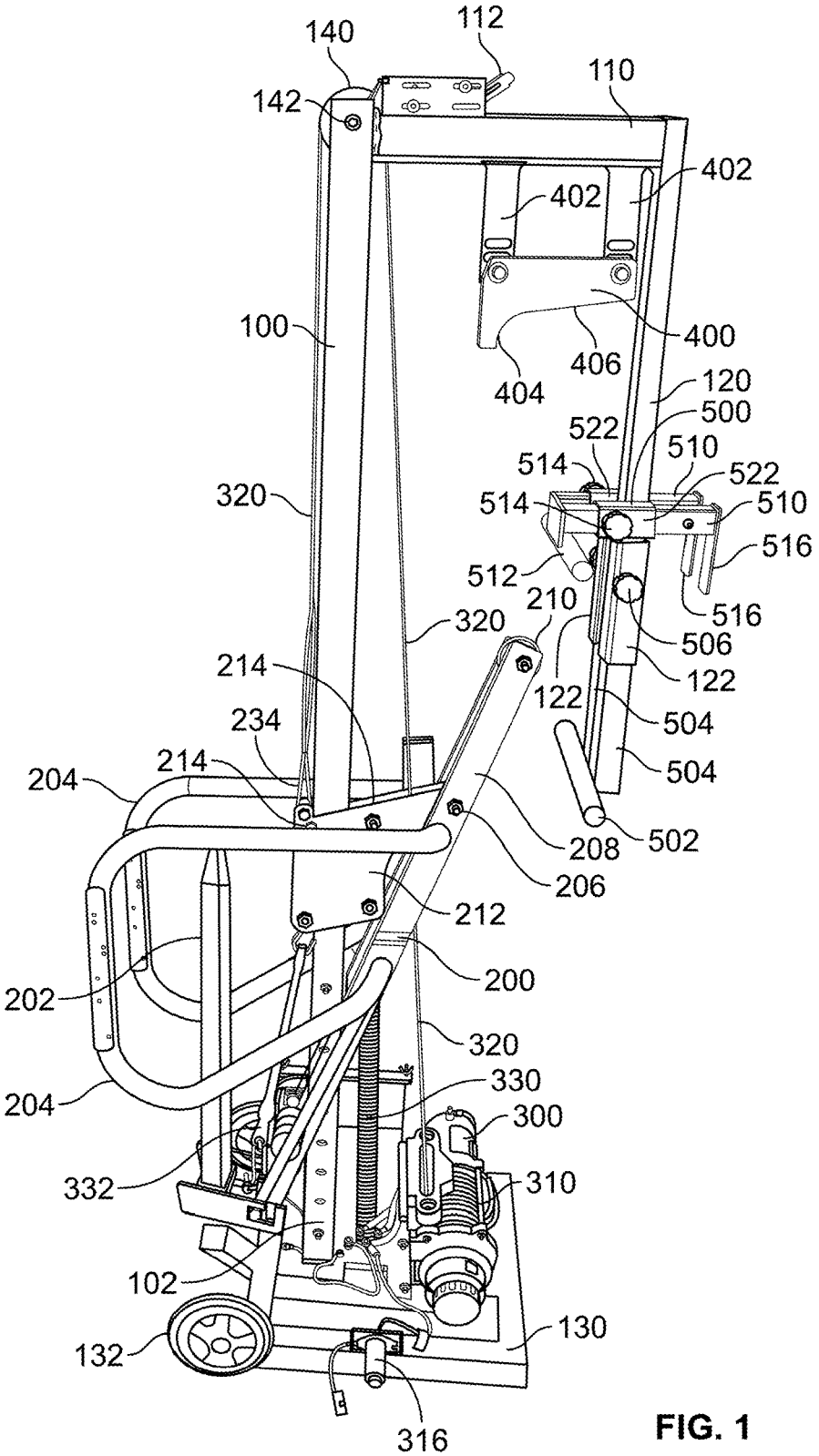
FIG. 1 is a left elevational view of an exemplary device in accordance with an embodiment of the present invention.
Figure 2:
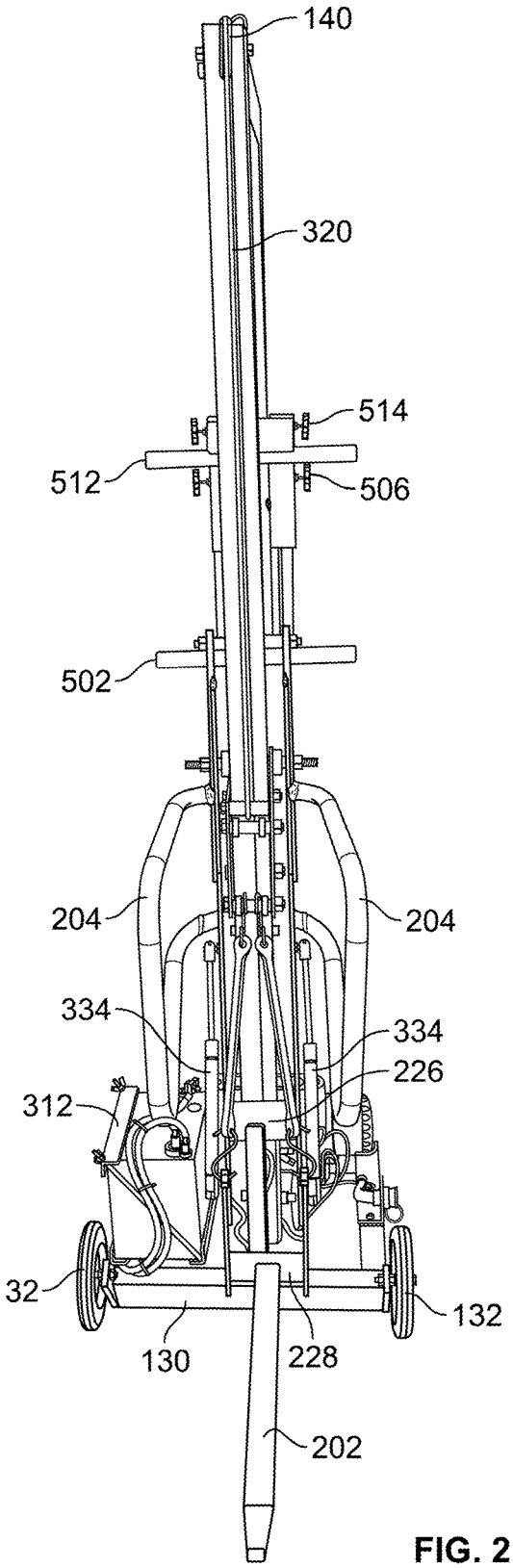
FIG. 2 is a front elevational view of the device of FIG. 1 with a loading spike in the extended position in accordance with an embodiment of the present invention.

FIG. 1 is a left elevational view of an exemplary device and FIG. 2 is a front elevational view of the device of FIG. 1 with the loading spike in the extended position in accordance with an embodiment of the present invention. The device is comprised of an extendable upper main body 100, top arm 110, and brace arm 120. The upper main body 100 is extendable from a lower main body 102 that is secured to a base 130 upon which a drive mechanism is located. A lift body 200 is slidably disposed about the main body 100, and is configured to be raised and lowered as guided by the main body 100. To do so, the drive mechanism comprises a bi-directional motor 300 attached to a spool, such as cable spool 310 on the base 130 of the device. A tension member, such as cable 320 is provided extending from the cable spool 310 upward, through an opening in the lift body 200, to a roller such as a pulley 140 at the top of the main body 100. The cable 320 passes over the pulley 140, and extends downward to a point 234 secured to the lift body 200. Accordingly, as the motor 300 advances the cable spool 310, the cable 320 is retracted by the cable spool 310 and lifts the lift body 200 toward the pulley 140. In a reverse operation, as the motor 300 reverses the cable spool 310, the cable 320 is released by the cable spool 310 and lowers the lift body 200 toward the base 130 of the device as shown in FIGS. 5 to 8. FIGS. 5 to 8 are left side elevational views illustrating a lifting operation in accordance with an embodiment of the present invention. An elastic member such as a coil spring 330 may be provided between the lift body 200 and base 130 to smoothly urge the lift body 200 into the lowered position as the cable 320 is released by the cable spool 310 and lowers the lift body 200. One or more elastic straps 332 may also be provided to smoothly urge the tilted lift body 200 into an untilted position as the cable 320 is released by the cable spool 310 and lowers the lift body 200. One or more pneumatic pistons 334 may also be provided to assist the extension and retraction of a loading spike 202 of the lift body 200 as described in greater detail below.

The main bodies 100 and 102, top arm 110, brace arm 120 and base 130 can be constructed of any suitable material but exemplary embodiments of the present invention shown are constructed of square steel tubing which can be easily welded and drilled for assembly and adjustments, but embodiments are not limited thereto. In this or other embodiments, flat and/or angle steel, round and/or square tubing steel or other material may be used to provide a strong but lightweight device to facilitate portability. In a preferred embodiment, the base 130 can be square or rectangle-shaped to provide a stable but small footprint for stably supporting the device and to facilitate storage. In one exemplary embodiment, the base 130 can be 20 inches (50 centimeters) wide and 20 inches (50 centimeters) deep, but embodiments are not limited thereto. The lower main body 102 may be welded or otherwise secured to the base 130, and the extendable upper main body 100 can be slidably disposed over the lower main body 102. The user can tilt and balance the entire device on wheels 132 secured to one side of the base 130, and easily roll the tilted device to or from the receiving container. A number of adjustment holes can be drilled in both main bodies 100 and 102 such that the extendable upper main body 100 can extend to a height of up to 60 inches (152 centimeters) in one exemplary embodiment, and be secured at any one of a plurality of heights by aligning the adjustment holes and inserting a bolt or pin therein as described in greater detail below.

The top arm 110 may be welded or otherwise secured to the upper main body 100, and extend at a substantially 90 degree angle from the main body 100 in one exemplary embodiment, but is not limited thereto. The top arm 110 can extend up to 24 inches (61 centimeters) from the main body 100 in one exemplary embodiment to an opposite end on which the brace arm 120 can be secured. The brace arm 120 may be welded or otherwise secured to the top arm 110, and extend at a substantially 90 degree angle from the top arm 110 and substantially parallel to the main body 100, but is not limited thereto. The brace arm 120 can extend 30 inches (76 centimeters) from the top arm 110 in one exemplary embodiment and be used to support a slidable brace assembly at a lower end to releasable secure the device to a side wall of a receiving container (not shown).

At the top of the upper main body 100, the pulley 140 can be positioned within a notch or slot, or supported by a pin or bolt, provided in the top end of the main body 100 at or near the point of coupling with the top arm 110, but embodiments are not limited thereto. The pulley 140 can have any suitable diameter, but is preferably a 3 inch (8 centimeters) diameter pulley, rotatably mounted on a shouldered bolt or pin 142 extending through the main body 100 for rotatably supporting the cable 320.

The top arm 110 is also provided with a plurality of brackets 402 to secure a tilt plate 400 beneath the top arm 110 such that a tilt roller 210 of the lift body 200 contacts the tilt plate 400 as the lift body 200 is lifted by the cable 320.

Figure 5:
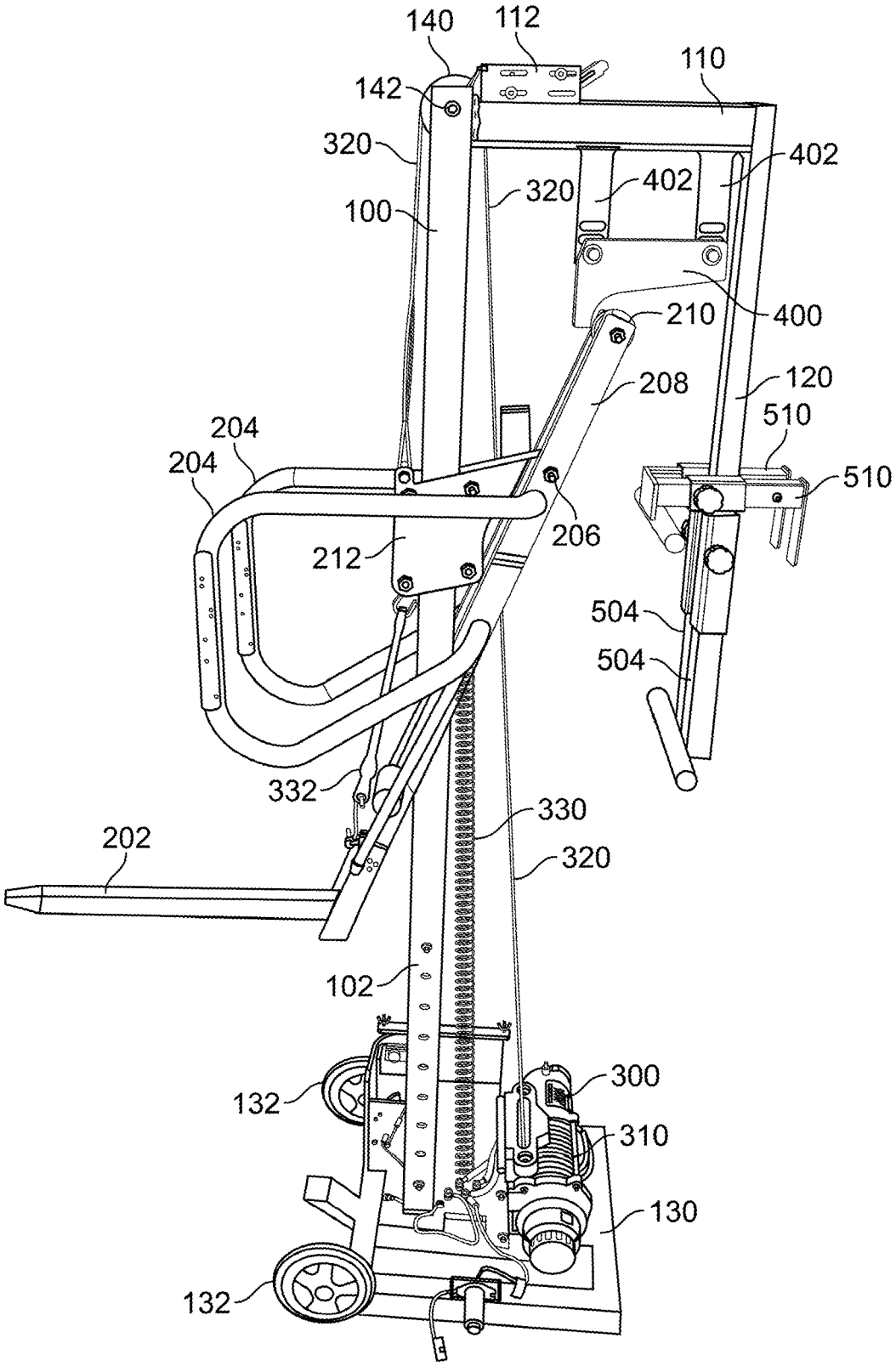
FIGS. 5 to 8 are left side elevational views illustrating a lifting operation of the device of FIG. 1 in accordance with an embodiment of the present invention.
Figure 6:
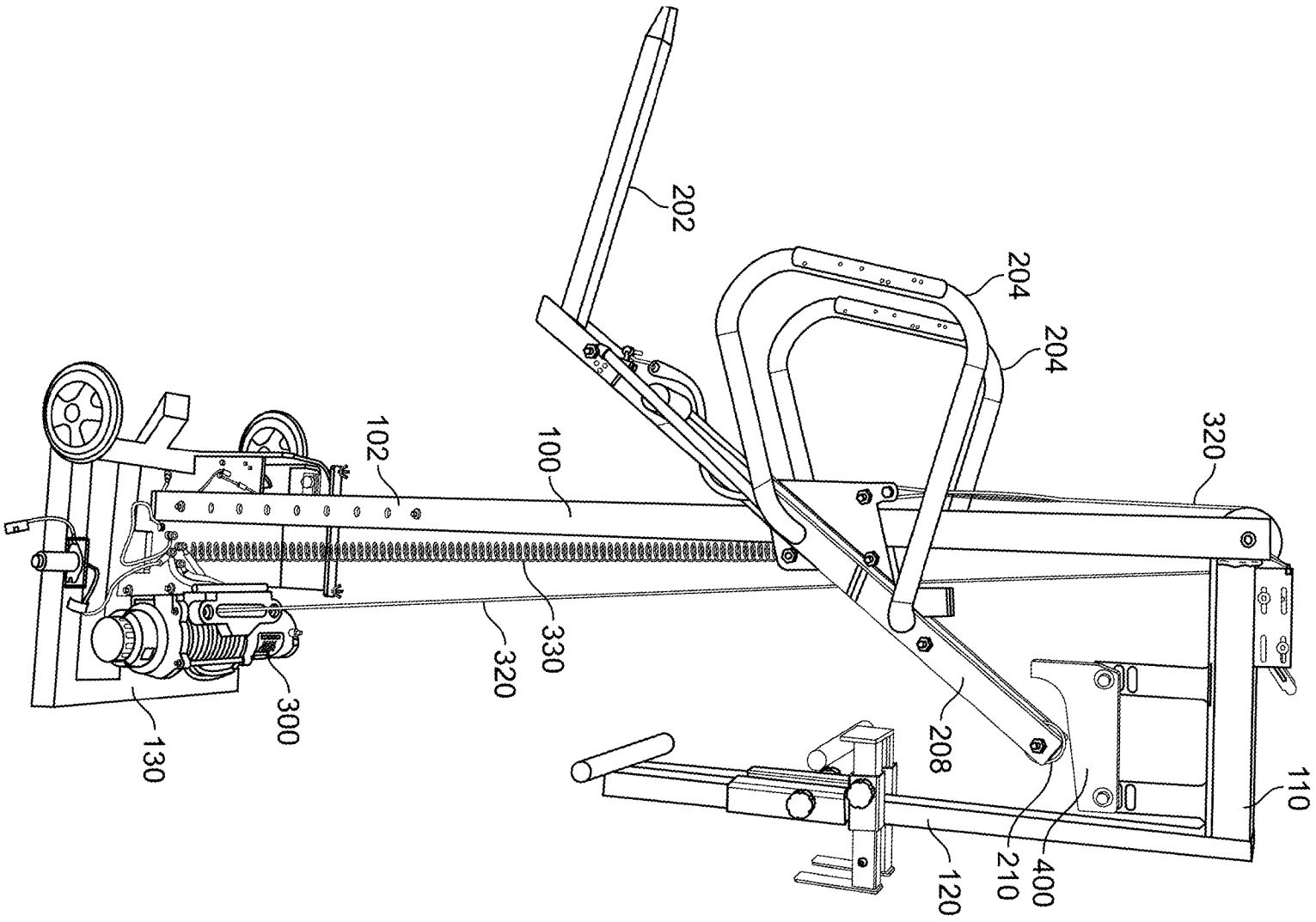
Figure 7:
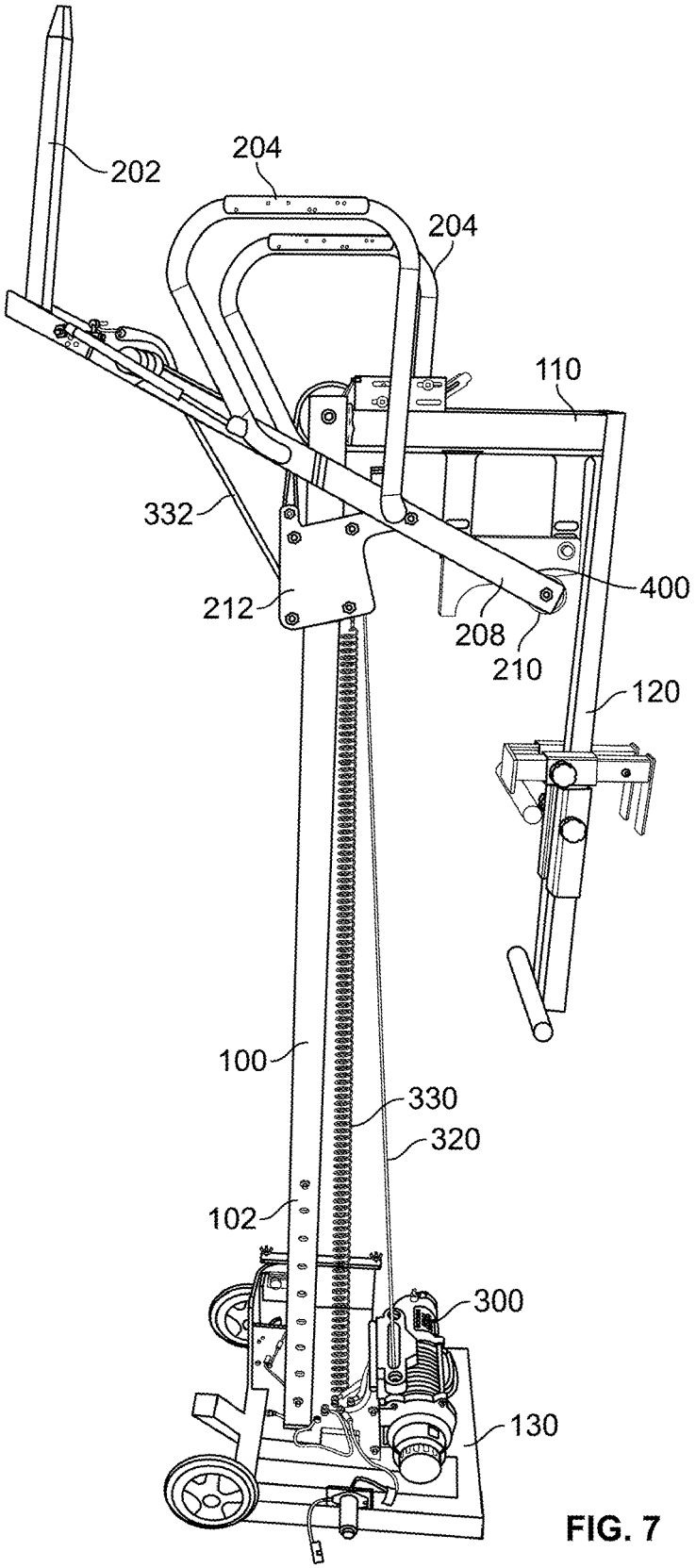
Figure 8:
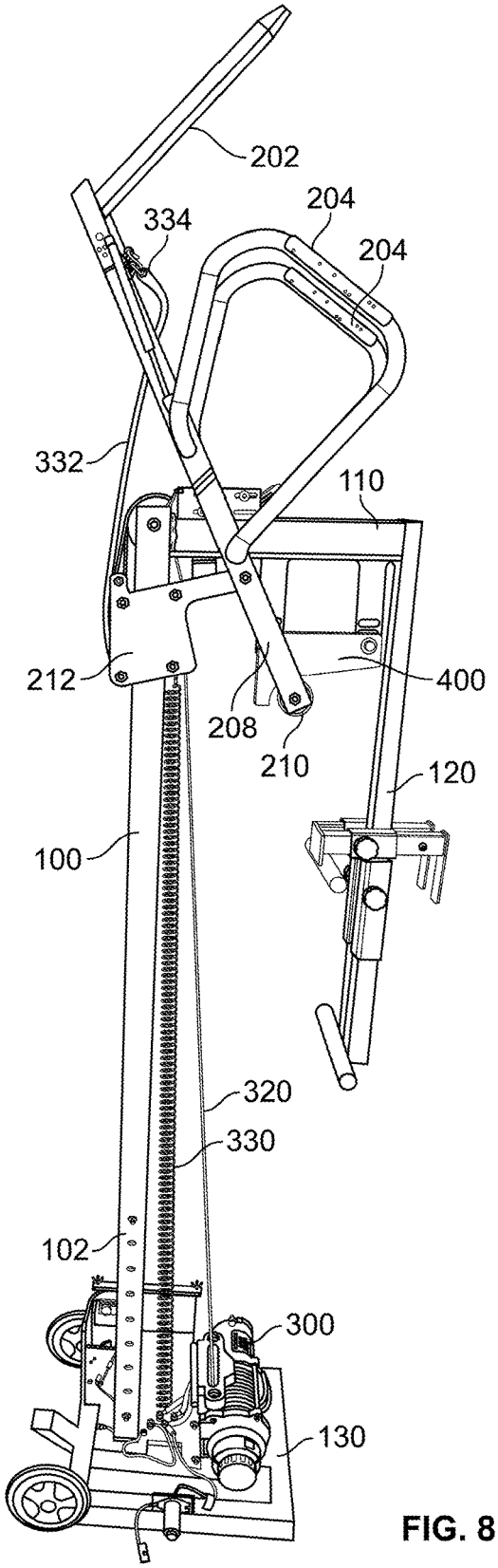

As described in greater detail below, the tilt roller 210 is secured at one end of a tilt arm 208 of the lift body 200. The loading spike 202 of the lift body 200 is secured at the opposite end of the tilt arm 208. Specifically, the tilt plate 400 comprises a first end 404 that provides a contour or deflection radius to deflect the tilt roller 210 upon initial contact between the tilt roller 210 and the tilt plate 400 as shown in FIG. 5. The tilt plate 400 comprises a second end 406 that provides another contour or deflection radius, different than the deflection radius of the first end 404, to further deflect the tilt roller 210 as the lift body 200 is lifted further as shown in FIGS. 6 and 7. Finally, as the lift body 200 is lifted to the complete up position and passes the tilt plate 400, the tilt roller 210 is pulled, urged or free to move back toward the first end 404 of the tilt plate 400, thereby allowing the lift body 200 to reach a complete tilted position as shown in FIG. 8.

A switch or sensor, such as a roller arm switch 112 may be provided on a top surface of the top arm 110 to detect the lift body 200 in the lifted and tilted position, and directs the controller to stop and/or reverse the motor 300 as described in greater detail below. A similar operation is performed by a switch or sensor, such as a leaf switch 114 provided near a lower end of the main body 100 to detect the lift body 200 in the down position, and also directs the controller to stop and/or the motor 300 as described in greater detail below.

The brace arm 120 is secured to the top arm 110 at one end, and includes a brace assembly 500 at an opposite end to secure the device to a receiving container. Once the device is placed adjacent to a receiving container (not shown), the brace assembly 500 can be lowered against a top surface of the receiving container sidewall, and contracted to releasably capture the sidewall of the receiving container. Although not shown, any portion of the device can be provided with safety covers, guards and/or shields, with or without sensor switches that prevent operation when the covers are not securely in place.

The brace assembly 500 may include a first handle 502 to allow a user to raise and lower a vertical adjusting members 504, and a second handle 512 to allow a user to retract and extend a horizontal adjusting members 510. The handles 502 and 512 can be comprised of any suitable material, such as 1 inch (2.5 centimeters) round steel stock in an exemplary embodiment. The handle 502 may be welded or otherwise secured to a lower end of the vertical adjusting members 504 and the handle 512 may be welded or otherwise secured to an inner end of the horizontal adjusting members 510.

Figure 12:
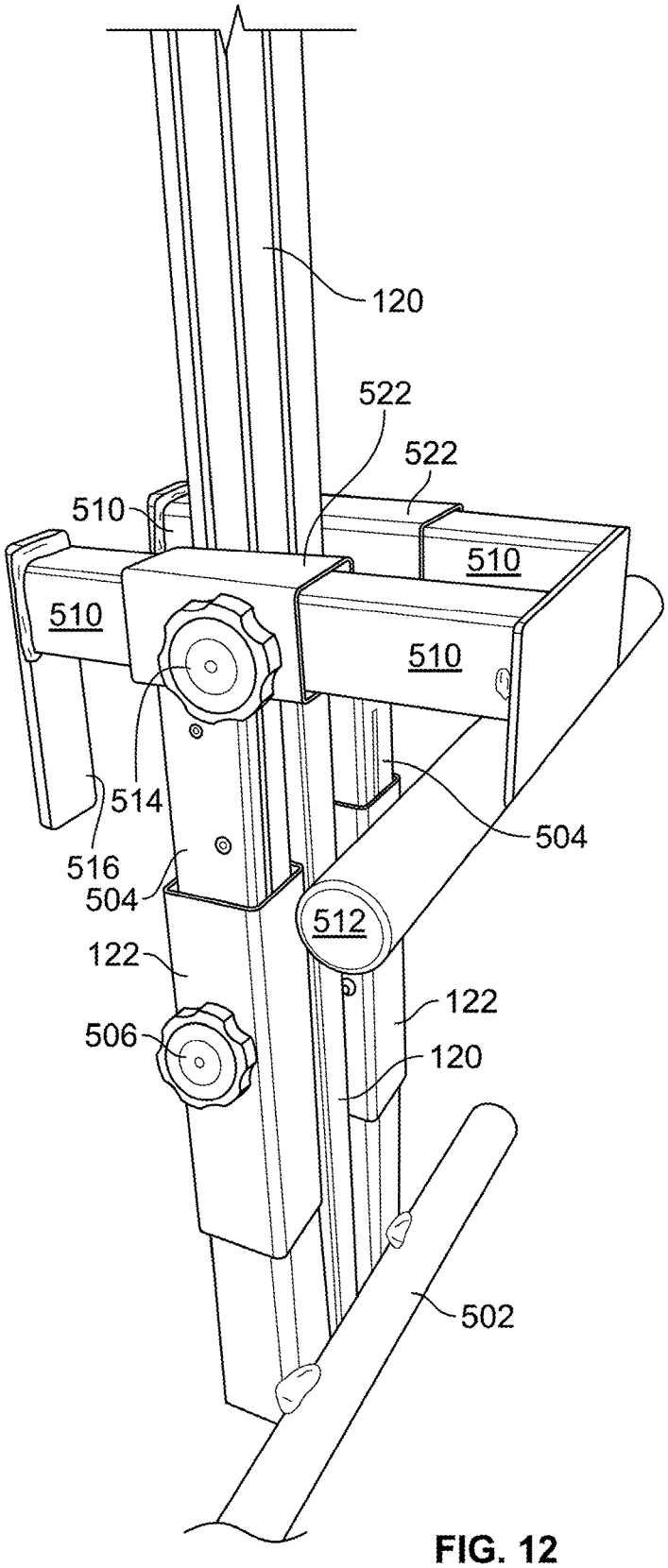
FIG. 12 is a perspective view of the brace assembly of the device of FIG. 1 in accordance with an embodiment of the present invention.

FIG. 12 is a perspective view of the brace assembly 500 of the device to releasably capture a sidewall of a receiving container. To provide vertical adjustments of the brace assembly 500, the brace arm 120 extends downward between parallel members of both the vertical adjusting members 504 and the horizontal adjusting members 510, and includes open tube channels 122 welded or otherwise secured on opposite sides of the brace arm 120 and through which the vertical adjusting members 504 slidably extend. That is, the vertical adjusting members 504 are slidably disposed on opposite sides of the brace arm 120, in a parallel fashion, and are slidably disposed within the opposite open tube channels 122 of the brace arm 120.

To provide horizontal adjustments of the brace assembly 500, opposite open tube channels 522 may be welded or otherwise secured at a top end of the vertical adjusting members 504 such that the open tube channels 522 can move vertically with the movement of the vertical adjusting members 504. The horizontal adjusting members 510 are disposed on opposite sides of the brace arm 120, in a perpendicular fashion, and are slidably disposed within the opposite open tube channels 522 of the vertical adjusting member. Each of horizontal adjusting members 510 includes a brace 516 which captures the inner surface of the receiving container wall when in position.

The vertical adjusting members 504 are moveable between vertical positions by loosening a threaded retention handle 506 and moving the vertical adjusting members 504 to the desired height position using the handle 502 and then tightening the threaded retention handle 506 to secure the vertical adjusting members 504 at the desired height. The threaded retention handle 506 may pass through an opening such as a threaded hole in at least one of the open tube channels 122 and can be tightened against an outer surface of at least one of the vertical adjusting members 504 but embodiments are not limited thereto. When the threaded retention handle 506 is loosened, the vertical adjusting members 504 can be raised or lowered on the brace arm 120. The vertical adjusting members 504 can be comprised of any suitable material, such as 1 inch (2.5 centimeters) square steel stock on opposite sides of the brace arm 120, but embodiments are not limited thereto. The vertical adjusting members 504 are configured to slidably pass through the open tube channels 122 that surround the brace arm 120 such that the brace arm 120 and channels 122 provide a guide for the movement of the vertical adjusting members 504. Further, the threaded retention handle 506 can be provided with a handle or other user-friendly gripping surface.

As noted above, the brace assembly 500 further includes the horizontal adjusting members 510 secured to the top end of the vertical adjusting members 504 such that the horizontal adjusting members 510 move vertically with the vertical adjusting members 504, and are independently moveable between horizontal positions by loosening another threaded retention handle 514 and moving the horizontal adjusting members 510 to the desired horizontal position and tightening the threaded retention handle 514 to secure the horizontal adjusting members 510 at the desired position (such as tightly gripping a wall of a receiving container). The threaded retention handle 514 may pass through an opening such as a threaded hole in at least one of the open tube channels 522 and can be tightened against an outer surface of at least one of the horizontal adjusting members 510. When the threaded retention handle 514 is loosened, the horizontal adjusting members 510 can be extended or retracted perpendicular to the brace arm 120. The horizontal adjusting members 510 can be comprised of any suitable material, such as 1 inch (2.5 centimeters) square steel stock on opposite sides of the brace arm 120, but embodiments are not limited thereto. The horizontal adjusting members 510 are configured to slidably pass through the open tube channels 522 that surround the brace arm 120 such that the brace arm 120 and channels 522 provide a guide for the movement of the horizontal adjusting members 510. Further, the threaded retention handle 514 can be provided with a handle or other user-friendly gripping surface.

Returning to FIG. 1, the device further comprises the lift body 200 to releasably secure a trash can (not shown), and lift and tilt the secured trash can into the receiving container secured by the brace assembly 500. The lift body 200 includes the retractable loading spike 202 that is rotatable about 90 degrees around a hinge 228, trash can support arms 204, tilt point 206, tilt arm 208 and tilt roller 210. The opposite sides 212 and/or rollers 214 and 226 may provide a guide for guiding the lift body 200 along the main body 100 during lifting.

The cable 320 is provided extending from the cable spool 310 upward to the pulley 140 at the top of the main body 100. The cable 320 passes over the pulley 140, and extends downward to a point secured to the lift body 200. Accordingly, as the motor 300 advances the cable spool 310, the cable 320 is retracted by the cable spool 310 and lifts the lift body 200 toward the pulley 140. In a reverse operation, as the motor 300 reverses the cable spool 310, the cable 320 is released by the cable spool 310 and lowers the lift body 200 toward the base 130 of the device. The spring 330 is also provided between the lift body 200 and base 130 to smoothly urge the lift body 200 into the lowered position as the cable 320 is released by the cable spool 310 and lowers the lift body 200.

As the lift body 200 is lifted, the tilt roller 210 of the lift body 200 contacts the tilt plate 400 which includes contours to contact and deflect the tilt roller 210 of the tilt arm 208 and thereby rotate the tilt arm 208 about the tilt point 206 as the lift body 200 is lifted. The tilt point 206 is provided at a corner of the sides 212 of the guide of the lift body 200 and can be comprised of any suitable feature, such as a shouldered bolt or pin about which the tilt arm 208 can rotate. The rotation of the tilt arm 208 about the tilt point 206 results in the trash can support arms 204 attached to the tilt arm 208 to also rotate as shown in FIGS. 6 to 8. Upon initial contact between the tilt roller 210 and the tilt plate 400 as shown in FIG. 5, the first end 404 of the tilt plate 400 provides a contour to deflect the tilt roller 210. The second end 406 of the tilt plate 400 provides a different contour to further deflect the tilt roller 210 as the lift body 200 is lifted further as shown in FIGS. 6 and 7. Finally, as the lift body 200 is lifted to the complete up position, the tilt point 206 passes the tilt plate 400 and the tilt roller 210 is pulled, urged or free to move back toward the first end 404 of the tilt plate 400, thereby allowing the lift body 200 to reach a complete tilted position of the trash can support arms 204 as shown in FIG. 8.

In such a lifted and tilted position, one or more features are provided to secure the trash can to the trash can support arms 204 and prevent undesired movement, such as slipping from the trash can support arms 204 into the receiving container or to the ground. One feature to secure the trash can from undesired movement is the provision of a textured surface on the support arms 204. The textured surface can be provided as a textured coating or by a texture treatment to the support arms 204 themselves. Another feature to secure the trash can from undesired movement is the provision of a trash can strap and latch 216 that is secured between the trash can support arms 204 and around a trash can placed there between. Still another feature to secure the trash can from undesired movement is the provision of the loading spike 202 to secure one or more of the trash can and trash can base to the device while the support arms 204 align the trash can in proper orientation for lift and rotation.

Figure 9:
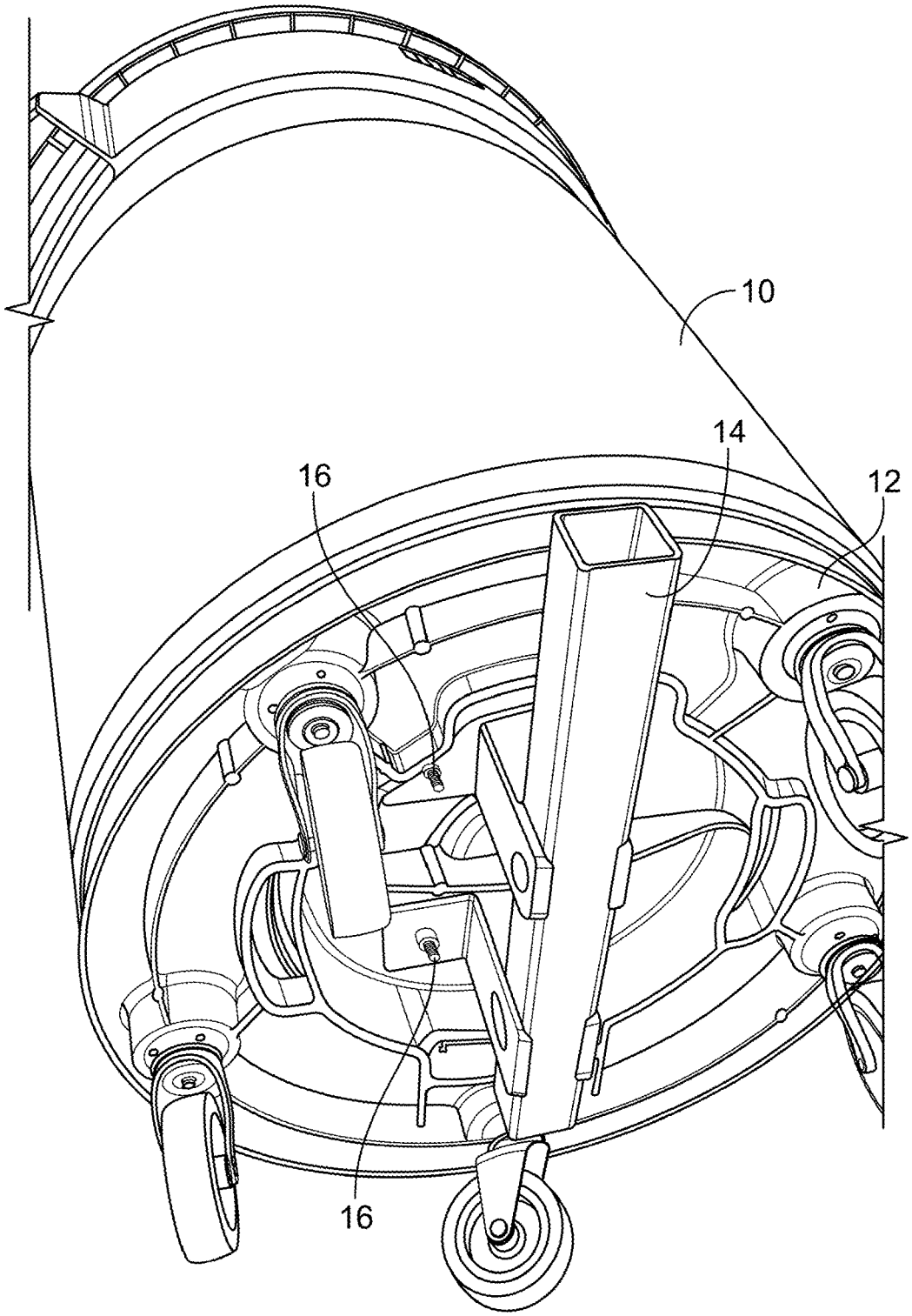
FIGS. 9 and 10 are perspective views of the loading spike and trash can loading spike tube of the device of FIG. 1 in accordance with an embodiment of the present invention.
Figure 10:
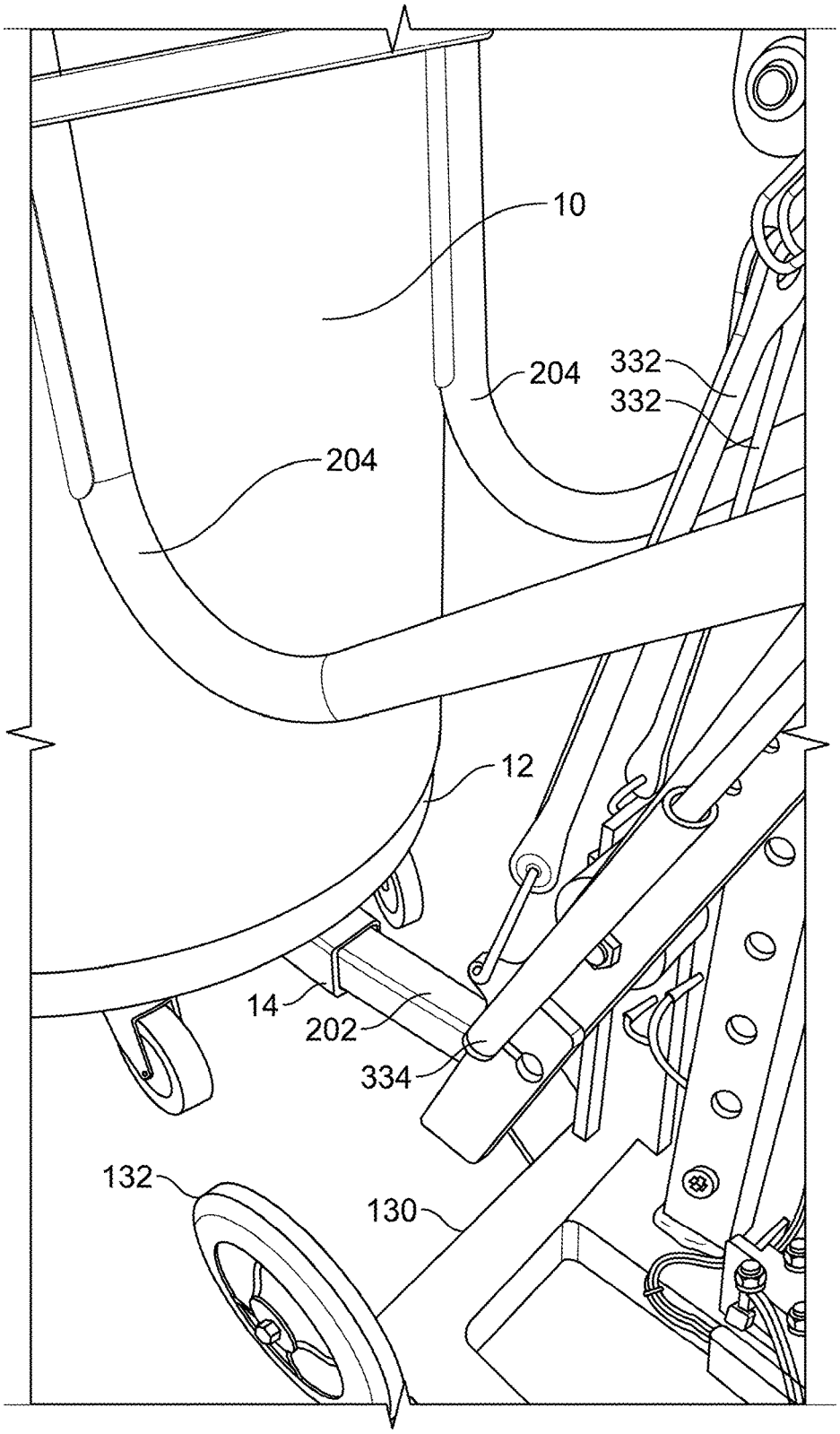

FIGS. 9 and 10 are perspective views of the loading spike 202 and trash can loading spike tube 14 of the device of FIG. 1 in accordance with an embodiment of the present invention. An exemplary trash can 10 is shown in a prone position, exposing a wheeled platform 12 releasably secured to a bottom surface of the trash can 10. The trash can 10 can comprise any one of many conventional devices currently available and be provided with the wheeled platform 12. In another exemplary embodiment, the platform can include a trash can loading spike but omit the wheels.

In the exemplary embodiment shown, the loading spike tube 14 may be secured to one or more of the trash can 10 and platform 12, and may be comprised of a metal tube or channel that can slidably receive the loading spike 202. In the exemplary embodiment shown, the loading spike tube 14 is comprised of a length of 2 inch (5 centimeters) square steel tubing, but embodiments are not limited thereto. The tubing 14 can extend up to the entire diameter of the platform 12, but is not limited thereto. The tubing 14 may be welded or otherwise secured to one or more brackets that can be bolted to a lower surface of the platform 12.

As shown in FIG. 10, the loading spike tube 14 slidably receives the loading spike 202. In an exemplary embodiment, the loading spike 202 may be comprised of a length of square steel tubing smaller than the inner dimensions of the loading spike tube 14, having a distal portion that is rounded and otherwise tapered to ease insertion into the loading spike tube 14. Further, by forming both the loading spike tube 14 and loading spike 202 using square tubing, the inserted loading spike 202 is prevented from twisting within the loading spike tube 14, such that the inserted loading spike 202 serves to prevent twisting or rotation of the container 10. In another embodiment, the loading spike can be configured as a fork or U-shaped member to encircle or otherwise secure the trash can.

The platform 12 may be provided with wheels to permit the trash can 10 and platform 12 to be moved toward the stationary loading spike 202, but embodiments are not limited thereto. The height of the platform 12 is configured to align the loading spike tube 14 and the loading spike 202 to ease insertion. One or more of the platform 12 and the loading spike 202 can further include vertical adjustments, such as threaded members 16, to further align the loading spike tube 14 and the loading spike 202 to ease insertion.

The loading spike 202 is rotatable about 90 degrees around the hinge 228 between an extended or down position and a retracted or up position. By moving the loading into the extended or down position, the loading spike 202 can be inserted into the loading spike tube 14. By moving the loading spike 202 into the retracted or up position when not in use or during movement of the device, the profile of the device is reduced, thereby making movement or storage of the device easier. Further, as noted above, one or more pneumatic pistons 334 may also be provided to assist the extension and retraction of the loading spike 202.

Figure 13:
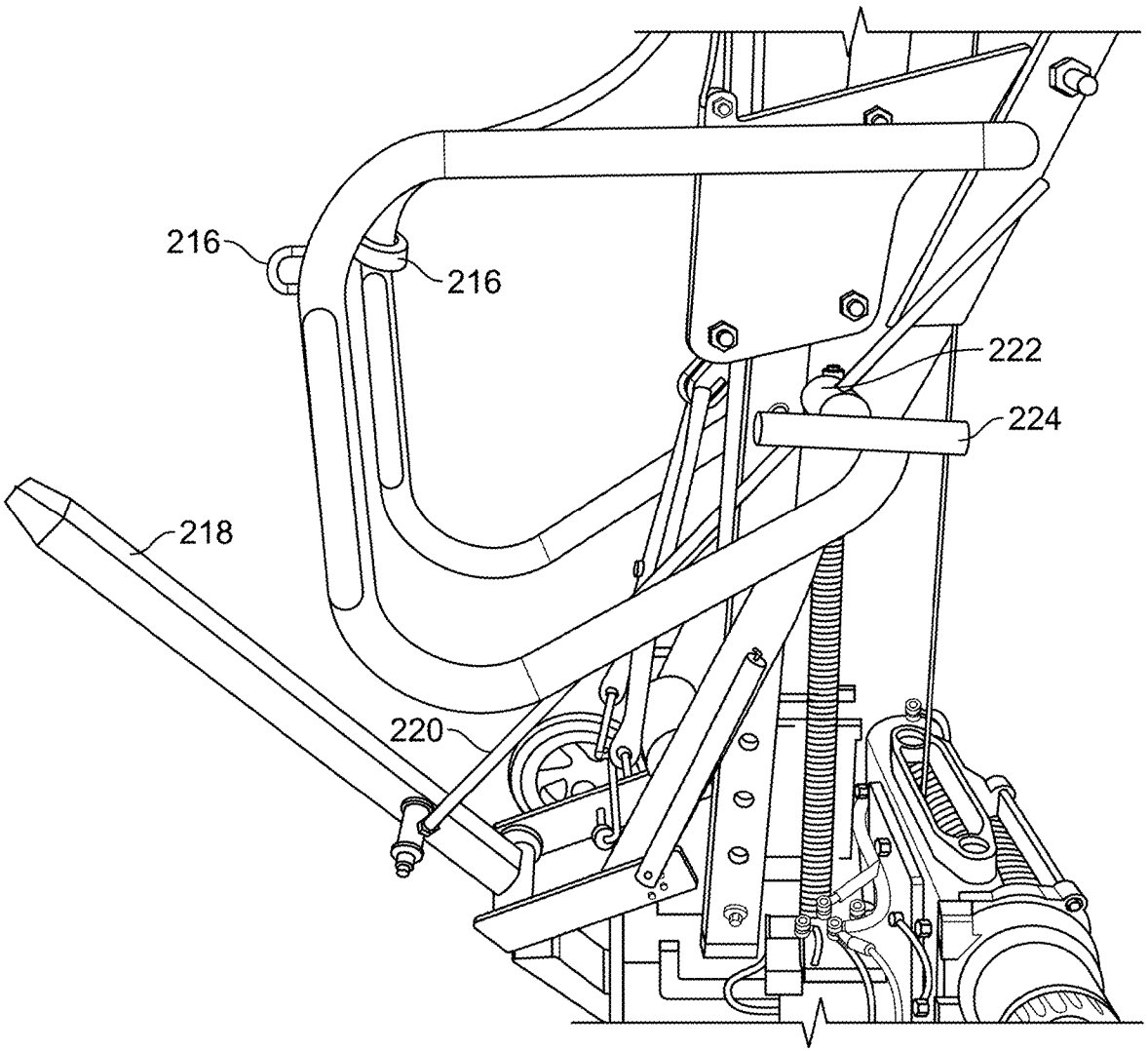
FIG. 13 is a perspective view of another loading spike embodiment of the device of FIG. 1.

Another embodiment of the loading spike which can be secured in position is shown in FIG. 13. The loading spike 218 is substantially the same as described above, but is provided with a locking arm 220. The locking arm 220 is rotatably secured to the loading spike 218, and passes through a locking block 222 that is rotatably secured to the device. The locking block 222 includes a threaded handle 224 that can be tightened against the locking arm 220 passing through the locking block 222 to lock the arm 220 and prevent any further linear movement of the arm 220 through the locking block 222. Both the locking block 222 and the locking arm 220 are configured to rotate to permit retraction and extension of the loading spike 218 as the locking arm 220 passes through the locking block 222 prior to tightening the threaded handle 224.

Figure 14:
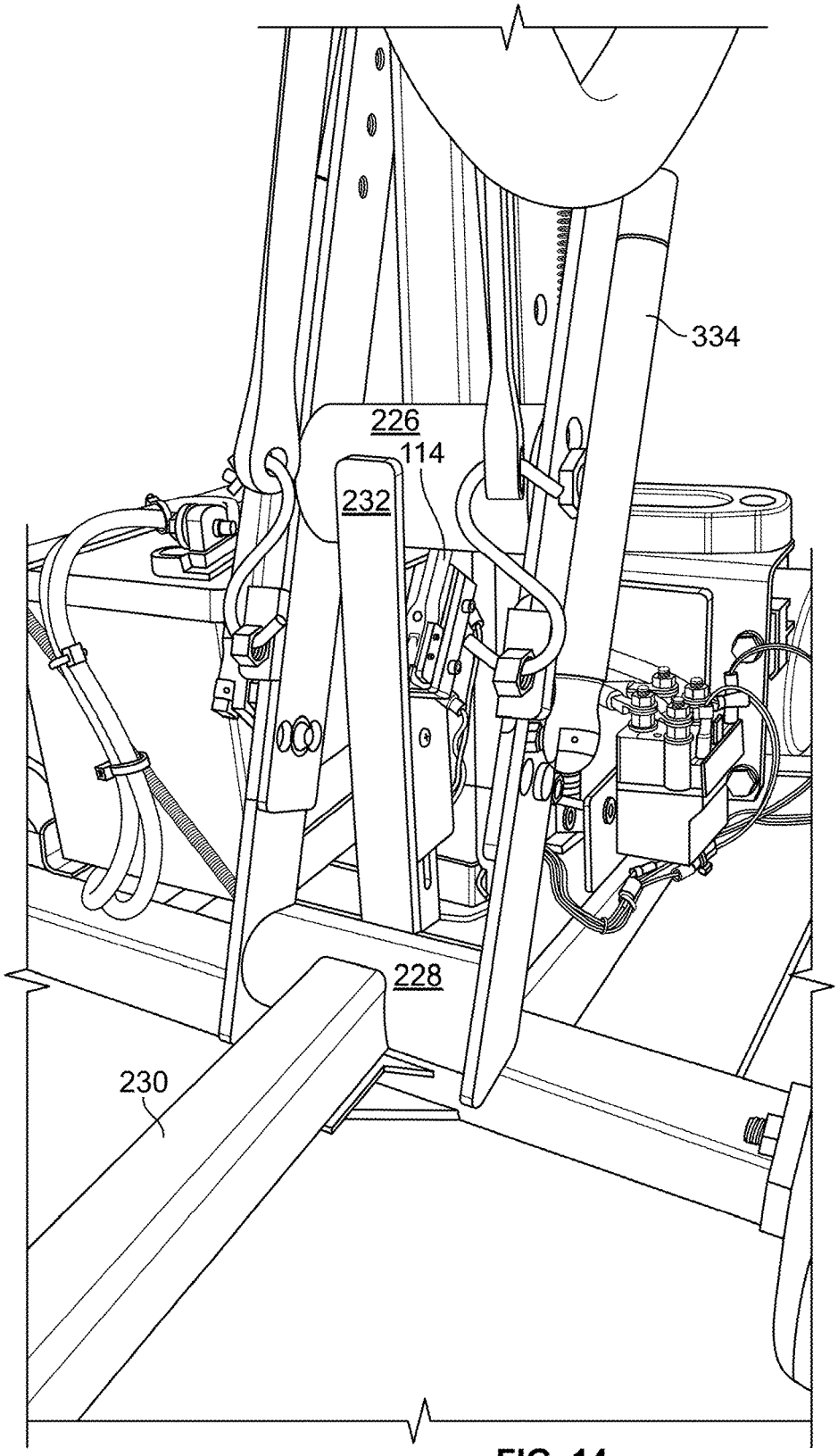
FIG. 14 is a perspective view of another loading spike embodiment of the device of FIG. 1.

Another embodiment of the loading spike is shown in FIG. 14. The loading spike 230 is substantially the same as described above, but is provided with a positive stop 232. When the loading spike 230 is rotated about the hinge 228 from the extended or down position to the retracted or up position, the travel of the loading spike 230 may be stopped by the positive stop 232. In an exemplary embodiment, the positive stop can be comprised of a metal or similar flat piece to obstruct further up rotation of the loading spike 230.

Figure 3:
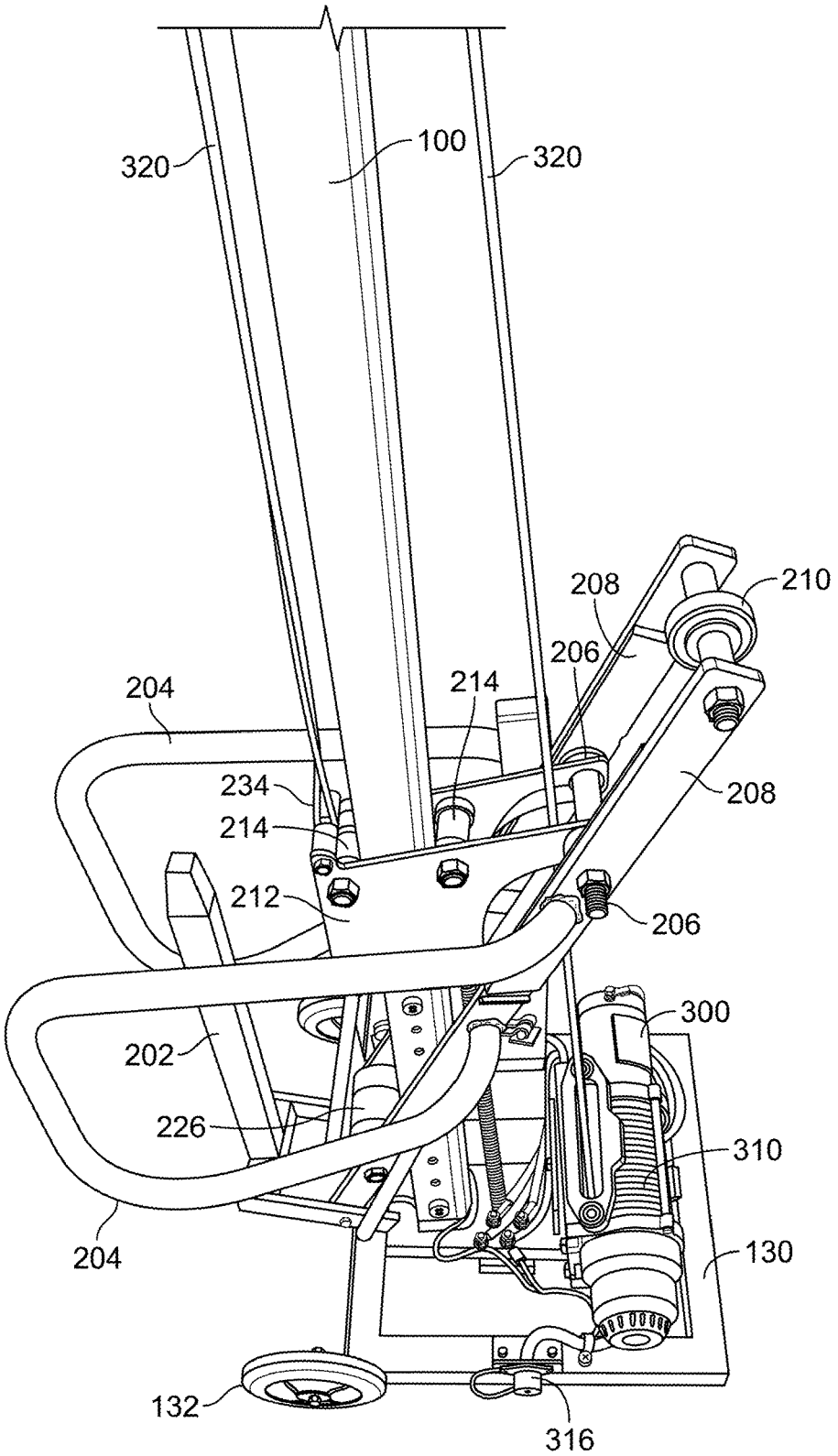
FIG. 3 is a perspective left view of a base of the device of FIG. 1 with the loading spike in the retracted position in accordance with an embodiment of the present invention.
Figure 4:
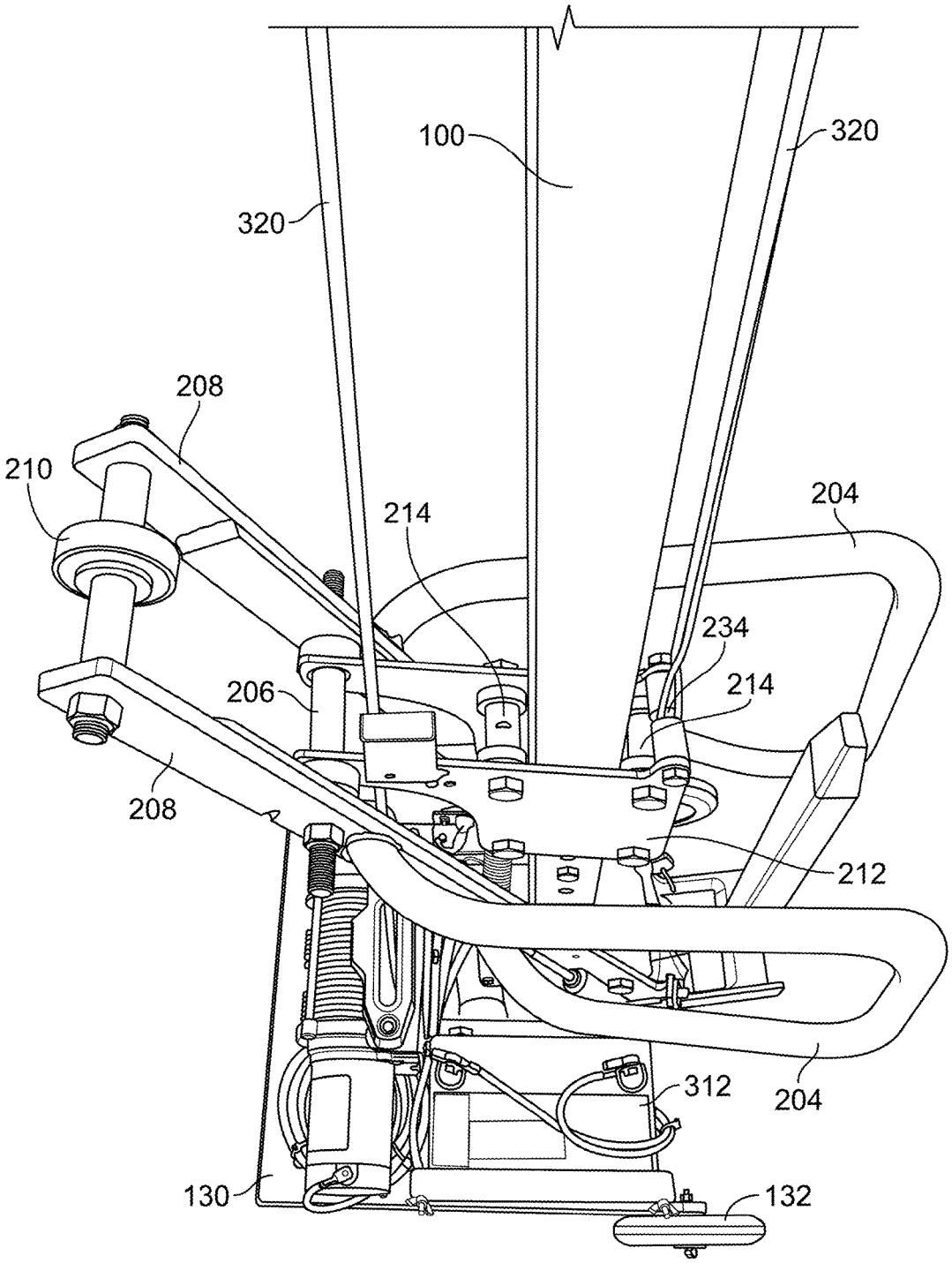
FIG. 4 is a perspective right view of the base of the device of FIG. 1 with the loading spike in the retracted position in accordance with an embodiment of the present invention.

The base 130 of the device is shown in greater detail in FIGS. 3 and 4. The base 130 includes the bi-directional motor 300, cable spool 310 and battery 312 of the drive mechanism of the device. For illustration purposes, the following description includes the provision of a battery-powered, electric motor as the drive mechanism. However, in yet other exemplary embodiments of the present invention or provided as a supplemental drive mechanism, a hand-crank and winch, or pulley, can be provided to serve as the drive mechanism. In this exemplary embodiment, the bi-directional motor 300 comprises an 18 volt smart motor and one or more integrated winches, but embodiments are not limited thereto. A 110/120 v or 220/240 v AC motor may also be used, with a cord connection to a convenient power outlet.

As known to those skilled in the art, a smart motor may describe an integrated servo motor system including for example, an encoder, amplifier, controller, and communication abilities. In one exemplary embodiment of the present invention, the smart motor is used automatically or as directed by a user control to lift and tilt the lift body 200 and, a trash can secured thereto. To do so, the smart motor is configured to sense the beginning and end of the lifting process, and abnormal or other alarming operating conditions, for control and safety purposes. In one exemplary embodiment of the present invention, the motor is configured to receive signals from sensors or other switches to detect the beginning and end of the lifting process, and abnormal or other alarming operating conditions, for control and safety purposes.

Figure 11:
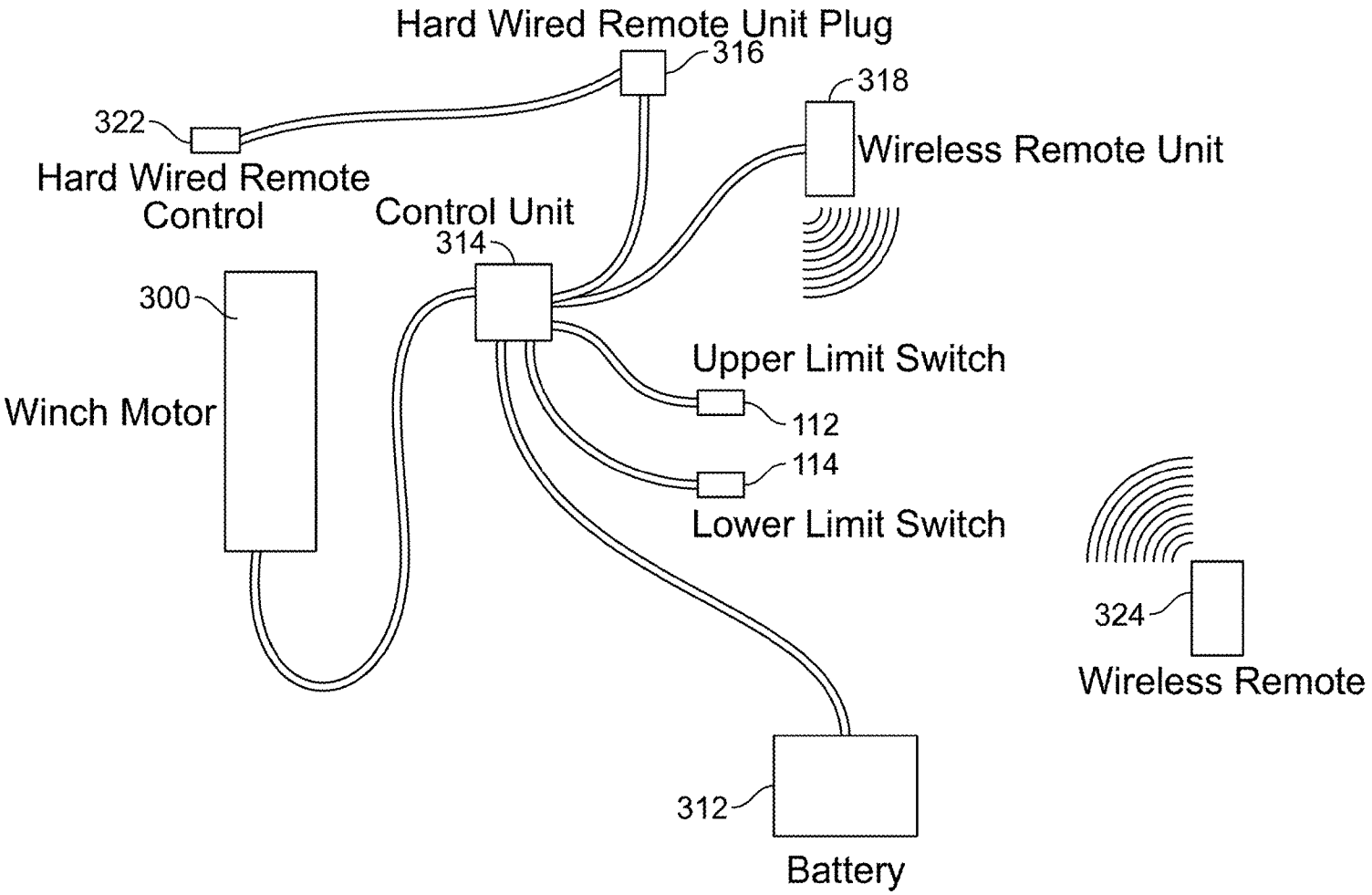
FIG. 11 is an electrical schematic of the device of FIG. 1 in accordance with an embodiment of the present invention.

A control schematic for an exemplary embodiment of the present invention is shown in FIG. 11. The schematic of FIG. 11 shows a 12 volt electric control system including a control unit 314 coupled to the motor 300 to provide stop and start control signals, including variable speed forward and reverse control signals. Speed control can also be provided using, for example, variable applied voltage or frequency, pulse width modulation, and so forth. The control unit 314 is also coupled to the switches 112 and 114 to detect travel positions of the lift body 200 as described above, and control the motor 300 in response. In one embodiment, the control unit 314 and switches 112 and/or 114 can be used switch polarity or other signals to the motor 300 using, for example, relays and/or contactors.

The control unit 314 is also coupled with a hard-wired remote unit plug 316 and/or a wireless remote unit 318 to receive operator control signals, such as those required to raise, pause and lower the lift body 200. One control option may be provided by a hard-mounted, 3-position, 2-way switch (not shown) located at any number of convenient locations on the device. Another control option may be provided by the hard-wired remote unit plug 316 removably coupled with a hard-wired remote control 322 which can be hand-held by a user to direct control of the device. The remote control 322 can extend from the drive mechanism to a user for ease of control of the device. The remote control 322 can provide any number and configuration of user-activated push buttons and switches such as, for example, on and off, and lift, pause and lower, but embodiments are not limited thereto. One or more of the buttons or switches can include a key lock for security and safety.

The wireless remote unit 318 can be used to wirelessly communicate with and receive commands from a wireless remote 324 which can be hand-held by a user to direct control of the device. The wireless communication can be provided by any suitable means such as RF, Bluetooth and infrared communication, and others as specified under the IEEE 802 wireless standards, including but not limited to 802.11 (WiFi, WLAN), 802.15 (WPAN, Bluetooth, ZigBee) and 802.16 (WMAN), but embodiments are not limited thereto.

The battery 312 can also be coupled with a charging connection (not shown) such that the battery can be charged during use, or when not in use. An electrical cord (not shown) can be provided to recharge the battery 312 or other power supply of the drive mechanism when not in use, or provide primary power to the drive mechanism if the power supply becomes low. The drive mechanism can be secured to the surface of the base 130 using any number of different attachment elements such as screws, bolts or other fasteners.

At least two control limit switches are provided with the control circuit. FIG. 1 shows the roller arm switch 112 provided on the top surface of the top arm 110 to detect the lift body 200 in a fully lifted and tilted position. FIG. 14 shows the leaf switch 114 provided near the lower end of the main body 100 to detect the lift body 200 in the fully down position. Each switch is adjustable, and is configured to generate a control signal for operation of the motor 300 once the lift body 200 is in one of an end-of-travel position.

Figure 15:
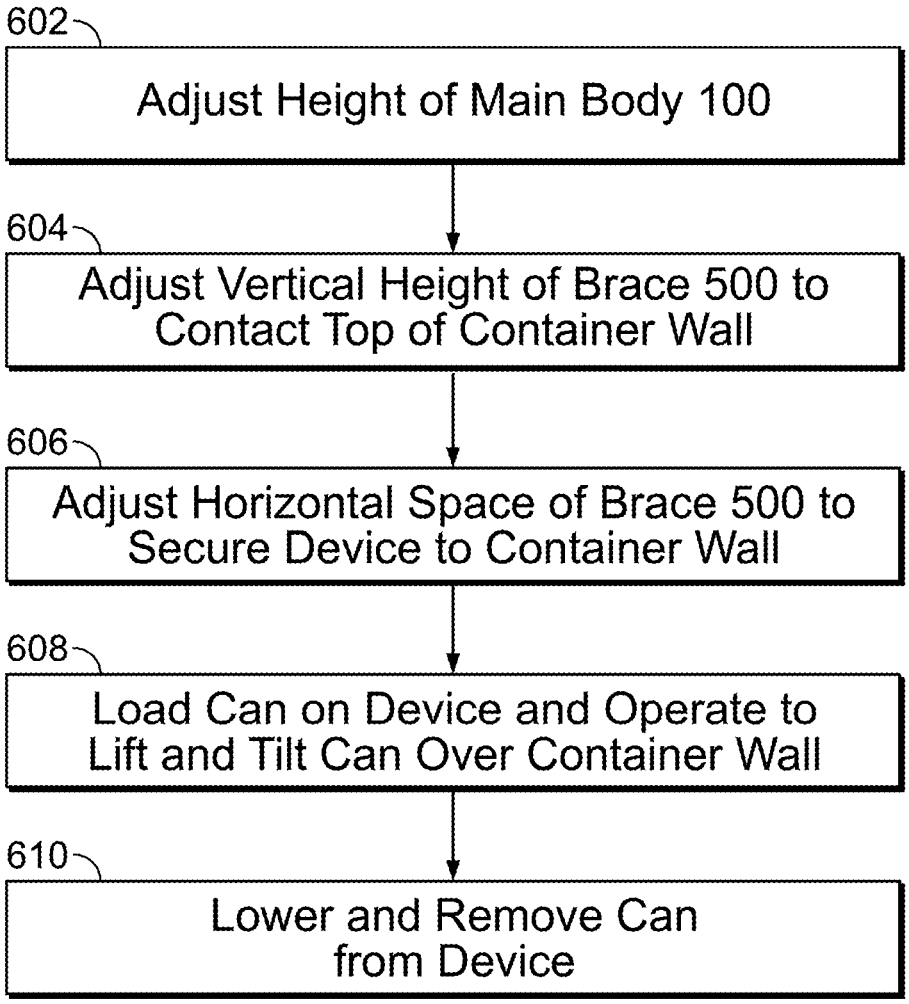
FIG. 15 is a flow chart illustrating an exemplary method of use in accordance with an embodiment of the present invention.

In a method of use illustrated in FIG. 15, the extendable upper main body 100 is first slidably extended over the lower main body 102 to a desired height, and is secured by aligning the adjustment holes and inserting a bolt or pin therein in step 602. By adjusting the main body 100 to a desired height, the brace assembly 500 can be positioned over the side wall of the receiving container. To do so, the user can tilt and balance the entire device on the wheels 132 and easily roll the device toward the side wall of the receiving container in a 2-wheeled, dolly-style mode of transportation.

Once the device is placed adjacent to the receiving container, the brace assembly 500 can be lowered against a top surface of the side wall of the receiving container. To do so, the user can loosen the handle 506 and the vertical adjusting members 504 can be lowered until the horizontal adjusting members 510 contact the top surface of the side-wall of the receiving container in step 604. The user can then tighten the handle 506.

Once the brace assembly 500 is against a top surface of the receiving container, the horizontal brace is adjusted to secure the wall of the receiving container. To do so, the user can loosen the handle 514 and the horizontal adjusting members 510 can be slid until the sidewall of the receiving container is tightly gripped in step 606. The user can then tighten the handle 514.

The user can then lower the loading spike 202 and place and secure a trash can onto the loading spike in step 608. Using the controls, the user can then direct the device to lift, tilt and empty the content of the trash can into the receiving container in step 608 as illustrated in FIGS. 5 to 8. The user can then lower and remove the trash can in step 610. The device can be left secured to the side wall of the receiving container for further use, or removed and rolled away in a reverse operation.

Although only a few exemplary embodiments of the present invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. A device for lifting a portable container and transferring contents therein, comprising:

a main body comprising a brace configured to releasably attach the main body of the device to a sidewall of a receiving container;

a lift body slidably disposed on the main body, comprising a loading spike configured to releasably secure a portable container, wherein the loading spike is rotatably connected to a first end of an arm;

a base comprising a drive mechanism, configured to vertically lift the loading spike and portable container secured thereto, and the arm connected to the loading spike; and the main body further comprising a tilt plate, configured to deflect a second end of the arm to rotate the arm about a tilt point, and rotate the loading spike and portable container secured thereto to transfer contents of the portable container to the receiving container, wherein the base further comprises a first and second wheel.

2. The device of claim 1, wherein the brace comprises:

a vertical adjusting member, slidably secured to the main body and moveable between vertical positions; and a first retention handle, to releasably secure the vertical adjusting member to the main body at a vertical position.

3. The device of claim 2, wherein the brace further comprises:

a horizontal adjusting member, slidably secured to the vertical adjusting member and moveable between vertical positions with the vertical adjusting member, and moveable between horizontal positions; and a second retention handle, to releasably secure the horizontal adjusting member to the vertical adjusting member at a horizontal position.

4. The device of claim 1, wherein the lift body further comprises a plurality of support arms configured to align the portable container while releasably secured to the loading spike.

5. The device of claim 1, wherein the drive mechanism further comprises a motor and tensioning member driven by the motor, to vertically lift the loading spike and portable container secured thereto, and the arm connected to the loading spike.

6. The device of claim 5, wherein an end of the tensioning member is secured to the lift body via a roller secured to the main body.

7. The device of claim 5, wherein the lift body further comprises a roller to guide the lift body along the main body as the drive mechanism vertically lifts the loading spike and portable container secured thereto, and the arm connected to the loading spike.

8. The device of claim 1, wherein the loading spike is rotatable between a substantially horizontal position and a substantially vertical position.

9. The device of claim 8, wherein the lift body further comprises a lock to releasably lock the loading spike in one of the horizontal position and the vertical position.

10. The device of claim 1, wherein the loading spike comprises a substantially square shape configured to be slidably received by the portable container, wherein the substantially square shape is configured to resist rotation of the portable container on the loading spike.

11. A device for lifting a portable container and transferring contents therein, comprising:

a main body comprising a brace configured to releasably attach the main body of the device to a sidewall of a receiving container;

a lift body slidably disposed on the main body, comprising a loading spike configured to releasably secure a portable container; and a base comprising a drive mechanism, configured to lift the loading spike and portable container secured thereto and rotate the loading spike and portable container secured thereto to transfer contents of the portable container to the receiving container, wherein the base further comprises a first and second wheel.

12. The device of claim 11, wherein the brace comprises:

a vertical adjusting member, slidably secured to the main body and moveable between vertical positions; and a first retention handle, to releasably secure the vertical adjusting member to the main body at a vertical position.

13. The device of claim 12, wherein the brace further comprises:

a horizontal adjusting member, slidably secured to the vertical adjusting member and moveable between vertical positions with the vertical adjusting member, and moveable between horizontal positions; and a second retention handle, to releasably secure the horizontal adjusting member to the vertical adjusting member at a horizontal position.

14. The device of claim 11, wherein the lift body further comprises a plurality of support arms configured to align the portable container while releasably secured to the loading spike.

15. The device of claim 11, wherein the drive mechanism further comprises a motor and tensioning member driven by the motor, to lift the loading spike and portable container secured thereto and rotate the loading spike and portable container secured thereto to transfer contents of the portable container to the receiving container.

16. The device of claim 11, wherein the loading spike is rotatable between a substantially horizontal position and a substantially vertical position.

17. The device of claim 11, wherein the loading spike comprises a substantially square shape configured to be slidably received by the portable container, wherein the substantially square shape is configured to resist rotation of the portable container on the loading spike.

18. A device for lifting a portable container and transferring contents therein, comprising:

a main body comprising a brace configured to releasably attach the main body of the device to a sidewall of a receiving container;

a lift body slidably disposed on the main body, comprising a loading spike configured to releasably secure a portable container, wherein the loading spike is rotatably connected to a first end of an arm;

a base comprising a drive mechanism, configured to vertically lift the loading spike and portable container secured thereto, and the arm connected to the loading spike; and the main body further comprising a tilt plate, configured to deflect a second end of the arm to rotate the arm about a tilt point, and rotate the loading spike and portable container secured thereto to transfer contents of the portable container to the receiving container, wherein the loading spike is rotatable between a substantially horizontal position and a substantially vertical position, and wherein the lift body further comprises a lock to releasably lock the loading spike in one of the horizontal position and the vertical position.

* * * * *